US009670604B2

(12) United States Patent
Tsai

(10) Patent No.: US 9,670,604 B2
(45) Date of Patent: Jun. 6, 2017

(54) THREE DIMENSIONAL WEAVE FABRIC FOR PRODUCING A WOVEN ITEM

(71) Applicant: Avery Dennison Retail Information Services, LLC, Mentor, OH (US)

(72) Inventor: Yung-Wen Tsai, Taichung (TW)

(73) Assignee: AVERY DENNISON RETAIL INFORMATION SERVICES, LLC, Westborough, MA (US)

( * ) Notice: Subject to any disclaimer, the term of this patent is extended or adjusted under 35 U.S.C. 154(b) by 0 days.

(21) Appl. No.: 14/825,487

(22) Filed: Aug. 13, 2015

(65) Prior Publication Data

US 2016/0047072 A1 Feb. 18, 2016

Related U.S. Application Data

(60) Provisional application No. 62/038,598, filed on Aug. 18, 2014.

(51) Int. Cl.

| | |
|---|---|
| ***D03D 1/02*** | (2006.01) |
| ***D03D 1/00*** | (2006.01) |
| ***D03D 11/02*** | (2006.01) |
| ***D03D 3/08*** | (2006.01) |
| ***A42B 1/02*** | (2006.01) |
| ***D03D 15/04*** | (2006.01) |

(52) U.S. Cl.

CPC ..... *D03D 11/02* (2013.01); *A42B 1/02* (2013.01); *D03D 1/00* (2013.01); *D03D 3/08* (2013.01); *D03D 15/04* (2013.01)

(58) Field of Classification Search

CPC ..... D03D 1/02; D03D 11/00; D03D 11/02; D03D 25/005; D03D 1/00; D03D 13/004; D03D 3/02

See application file for complete search history.

(56) References Cited

U.S. PATENT DOCUMENTS

| | | | |
|---|---|---|---|
| 1,735,467 | A | 11/1929 | Lipper |
| 2,401,830 | A | 6/1946 | Kahil |
| 3,071,165 | A | 1/1963 | Truslow et al. |

(Continued)

FOREIGN PATENT DOCUMENTS

| | | | |
|---|---|---|---|
| EP | 1091027 | A1 | 4/2001 |

OTHER PUBLICATIONS

International Search Report and Written Opinion prepared for PCT/US2015/045032 dated Oct. 22, 2015.

*Primary Examiner* — Bobby Muromoto, Jr.
(74) *Attorney, Agent, or Firm* — Avery Dennison Retail Information Services, LLC

(57) ABSTRACT

A three dimensional weave fabric material is disclosed for use in producing woven hats and other items. The three dimensional weave fabric material having two layers of material, a face layer and a back layer. The face layer and the back layer are then woven together via floating threads to create predetermined patterns or areas where the two layers are not woven together. These areas which are not woven together create tubes. Specifically, the weaving is controlled by a computer program that will weave or not weave the two layers together. Once the weaving is complete, the three dimensional weave fabric material may be subject to post processing such as heat. The three dimensional material is then assembled to produce a woven hat.

20 Claims, 11 Drawing Sheets

(56) References Cited

U.S. PATENT DOCUMENTS

| | | | | | |
|---|---|---|---|---|---|
| 3,291,162 | A * | 12/1966 | Jamison | A61F 13/49003 | 139/383 R |
| 3,359,610 | A | 12/1967 | Faircloth | | |
| 3,553,066 | A * | 1/1971 | Cacalier et al. | D03D 15/00 | 156/84 |
| 4,685,151 | A * | 8/1987 | Kincheloe | A41D 13/018 | 2/16 |
| 5,436,044 | A * | 7/1995 | Pinkos | B60P 7/0869 | 139/383 R |
| 5,546,602 | A * | 8/1996 | Hale | A41D 13/0155 | 128/874 |
| 2005/0235509 | A1* | 10/2005 | Heath | A42B 1/245 | 33/512 |
| 2006/0179544 | A1* | 8/2006 | Knievel | A42B 1/041 | 2/181 |
| 2008/0143080 | A1* | 6/2008 | Burr | D04B 1/14 | 280/495 |
| 2009/0023352 | A1* | 1/2009 | Russell | A62B 35/04 | 442/182 |
| 2010/0050487 | A1* | 3/2010 | Weightman | G08B 13/2448 | 40/299.01 |
| 2010/0248574 | A1* | 9/2010 | King | D03D 11/00 | 442/205 |

* cited by examiner

THREE DIMENSIONAL WEAVE FABRIC FOR PRODUCING A WOVEN ITEM

BACKGROUND

The present invention relates generally to a woven tubular fabric or fabrics having unwoven areas that are created by novel weaving techniques. More particularly, the present disclosure relates to a three dimensional woven tubular fabric for producing woven hats and other items that provides a performance-enhancing, aesthetic function.

Fabrics are typically made from corresponding raw materials and are constructed by weaving, knitting, plaiting or braiding. For example, felt fabrics are produced by the interlocking of fibers. Fabrics are primarily classified into woven fabrics, knitted fabrics, felt fabrics, plaited fabrics, non-woven fabrics, laminated fabrics and molded fabrics by standard production methods thereof.

In a narrow sense, woven fabrics refer to fabrics or fabric components constructed by interlacing vertical warp threads with horizontal weft threads at right angles. Woven fabrics are the most widely used fabrics for under wears and outer wears. Knitted fabrics are constructed by making sets of threads into loops and combining the loops with one another in forward, backward, left and right directions. Knitted fabrics are rapidly produced by knitting and tend to be loose and elastic when being worn. Strands of fibers are interlocked by heat, moisture, pressure or striking to construct felt fabrics, thus eliminating the need for the use of threads. In plaited, braided and lace fabrics, individual threads are interlaced with sets of threads while sliding in any one direction to attain desired effects.

Non-woven fabrics are constructed by the application of adhesive materials, the attachment of fibers through chemical functions on the surface of the fibers, or the attachment of webs or sheets of thermoplastic fibers by heating. Laminated fabrics are constructed by laminating a foam to one or two woven fabrics to achieve improved flexibility and provide a cushiony feeling. The surface areas of molded fabrics are larger than those of the raw materials before extrusion. Molded articles (e.g., clothes) are cushiony, or are in the form of a pile or plate.

All of these fabrics are very wearable, match the functions of the human body, and are not readily deformed. Additionally, sewing and other fusion techniques are currently used to impart three dimensional shapes to fabrics. However, typically sewing and other fusion techniques currently used to impart three dimensional shapes to fabrics results in loss of the certain function attributes and other performance or aesthetic characteristics.

In an attempt to overcome the above problems, a three dimensional fabric has been created that comprises a face layer, and a back layer, woven together via floating threads. The face layer and the back layer are woven together to create predetermined patterns or areas where the two layers are not woven together. Thus, the floating threads comprise the threads connected to the stitched face layer and the stitched back layer in an alternating and repeating pattern. Specifically, the weaving is controlled by a computer program that will weave or not weave the two layers together. These areas which are not woven together effectively creating tubes, tunnels or areas where the threads are not attached to the face or back layer. Once the weaving is complete, the three dimensional weave fabric material may be heat treated. Where heat treating is used, the process shrinks the floating threads, causing manipulation of the tube or unwoven areas. Specifically, the tube or unwoven areas can puff or stand up more than if there was no heat treatment. Alternatively, the unwoven areas or tunnels or tubes can be created segments of the threads unattached, creating a space beneath the threads which forms the tube or tunnel Thus, the novel weaving technique along with the heat treating process, if used, allows for an enhanced performance function such as stretch. The woven components produced from this weaving process are then assembled into a woven hat or other items, such as apparel, footwear, outwear or the like.

SUMMARY

The following presents a simplified summary in order to provide a basic understanding of some aspects of the disclosed innovation. This summary is not an extensive overview, and it is not intended to identify key/critical elements or to delineate the scope thereof Its sole purpose is to present some concepts in a simplified form as a prelude to the more detailed description that is presented later.

The subject matter disclosed and claimed herein, in one aspect thereof, comprises a three dimensional or raised area weave fabric material for use in producing woven hats and other items such as apparel, footwear, outwear, apparel accessories and the like having textural attributes. For example, in addition to creating raised patterns or other textural elements, one could create brand or other trademark or trade dress type of indicia.

The three dimensional weave fabric material comprises two layers of material, a face layer and a back layer. Typically, the face layer and the back layer are manufactured of synthetic material, or synthetic blends, such as polyester, but any other suitable material can be used as is known in the art. The face layer and the back layer are then woven together via floating threads. The face layer and the back layer are woven together to create predetermined patterns or areas where the two layers are not woven together. These areas which are not woven together create tubes, tunnels or free, unwoven areas. Specifically, the weaving is controlled by a computer program that will weave or not weave the two layers together and can be used to create a plethora of patterns and designs.

In one exemplary embodiment, once the weaving is complete, the three dimensional weave fabric material is heat treated. The heat treating process shrinks the floating threads, causing manipulation of the tube or tunnel Specifically, the tube or unwoven area puffs or stands up more than if there was no heat treatment. The heat treated, three dimensional weave fabric components are then assembled to produce a woven hat or other item. Specifically, the three dimensional weave fabric components are shaped to form different segments (or parts) of the woven hats. The woven hats are then produced by assembling the plurality of different woven components.

Additionally, the tubes can be filled with fibers or other suitable materials as is known in the art to make the puffed areas more firm, or to add texture or other similar features. Furthermore, the patterns and/or designs can be woven over the entire area of the hat, or just in limited areas on the hat, such as where one might create brand or trademark indicia, depending on the needs and wants of a user as well as manufacturing constraints. There can be a plurality of the same pattern and/or design, or a mixture of patterns and/or designs. The different size and/or shape of the patterns and/or designs are created by varying the size of the tube that is woven.

In a still further embodiment, the unwoven areas or tubes, are not subject to heat treatment and may remain relatively loose creating, in the situation of a repeating pattern a relatively ratio of woven to unwoven areas of about 1 to 1. Other ratios of woven and unwoven areas can also be created where there are considerable spacing areas between the next unwoven area such that woven to unwoven areas can range from about 1 to 2 to about 1 to 10. The ratio being determined by measure the length and/or width of the woven area to the length and/or width of the unwoven areas.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1A:
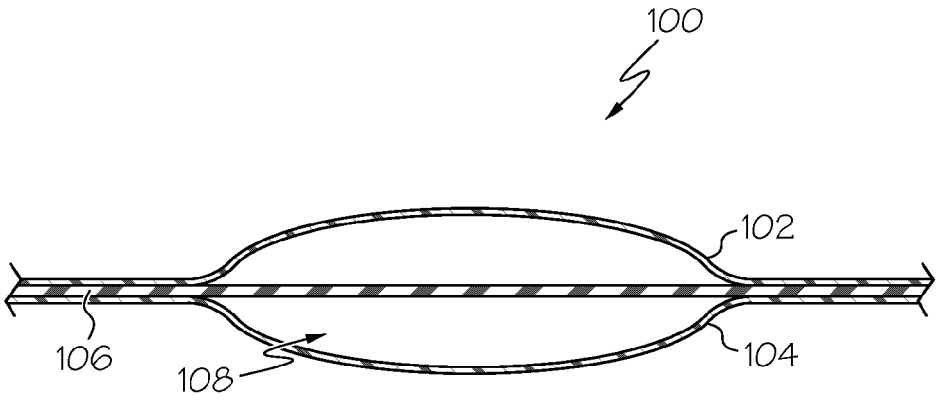
FIG. 1A illustrates a side sectional view of the three dimensional weave fabric material before heat treating in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Sewing and other fusion techniques are currently used to impart three dimensional shapes to fabrics. However, typically sewing and other fusion techniques currently used to impart three dimensional shapes to fabrics results in loss of the stretch and other desirable functions and other performance characteristics. In an attempt to overcome the above problems, a three dimensional weave fabric material is disclosed for use in producing woven hats and other items, such as apparel, outerwear, footwear, accessories and the like. The three dimensional weave fabric material comprises two layers of material, a face layer and a back layer. The face layer and the back layer are then woven together via floating threads to create predetermined patterns or areas where the two layers are not woven together.

These areas which are not woven together create tubes. Specifically, the weaving is controlled by a computer program that will weave or not weave the two layers together. Once the weaving is complete, the three dimensional weave fabric material may be heat treated or subject to other post weaving treatment or no treatment at all. If a heat treating process is used, the heat shrinks the floating threads, causing manipulation of the tube, tunnel or unwoven areas. Specifically, the tube puffs or stands up more than if there was no heat treatment. Additionally, the tubes can be filled with fibers or other suitable materials to make the puffed areas more firm. Then, the heat treated three dimensional weave fabric components are assembled into a woven hat or other item.

In constructing a hat or other apparel accessory for example, e.g. footwear, purses, and as seen from the attached drawings, individual components, sides, back, front, top, bottom, etc. can be woven independently to create unique designs on each component or the same design or one or more components. For example several individual components can have a repeating pattern while another component may have a brand distinguishing element such as a trademark. Once all the components are woven, then the individual components can be sewn together to form a finished article. For example, in the case of forming a hat, there may be six individual components which are then assembled to form the particular piece.

Figure 1B:
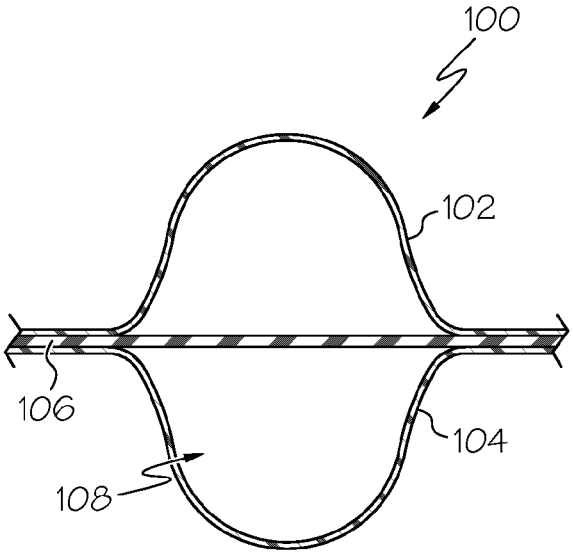
FIG. 1B illustrates a side section view of the three dimensional weave fabric material after heat treating in accordance with the disclosed architecture.
Figure 2:
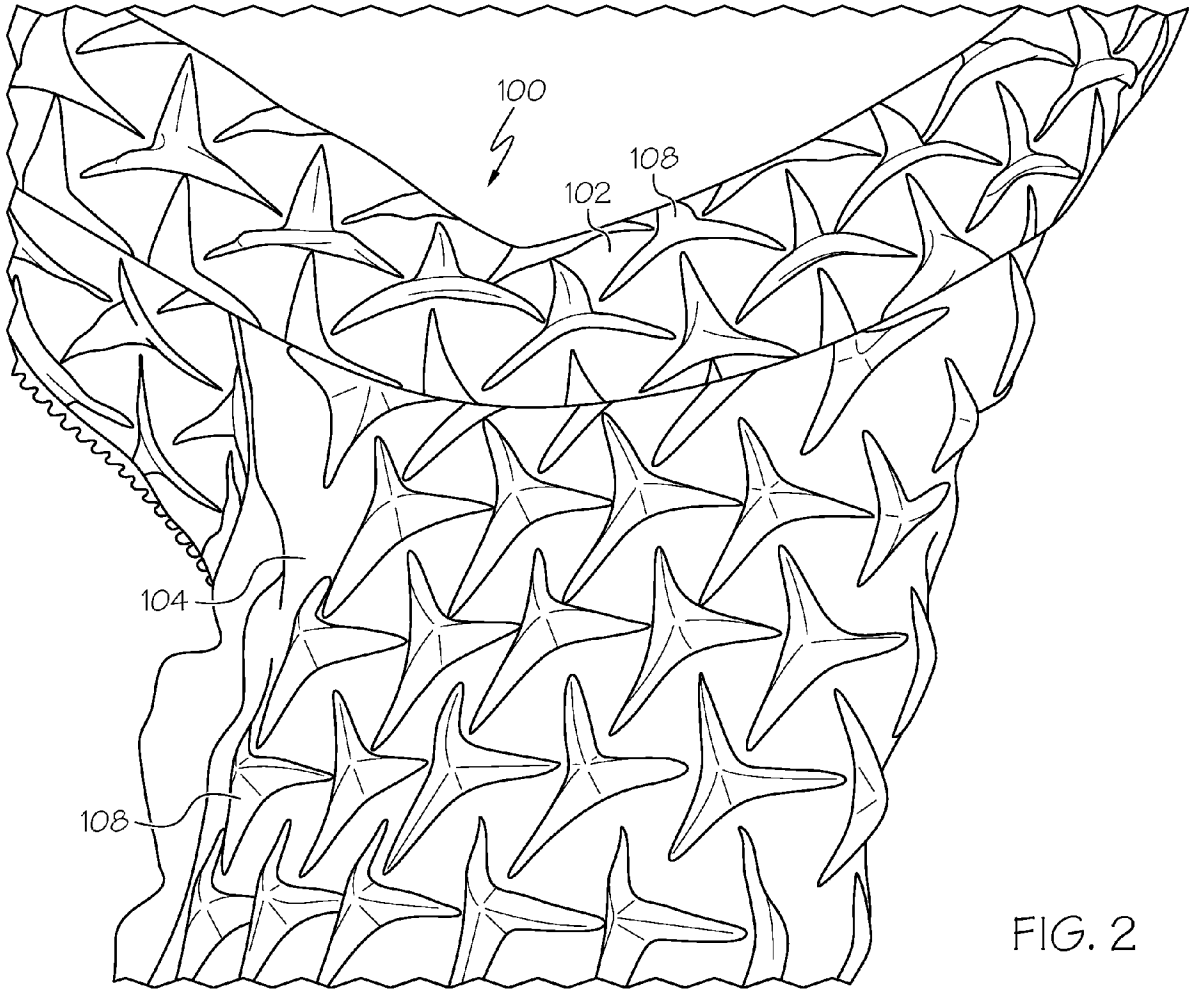
FIG. 2 illustrates a perspective view of the face layer and the back layer of the three dimensional weave fabric material in accordance with the disclosed architecture.
Figure 3:
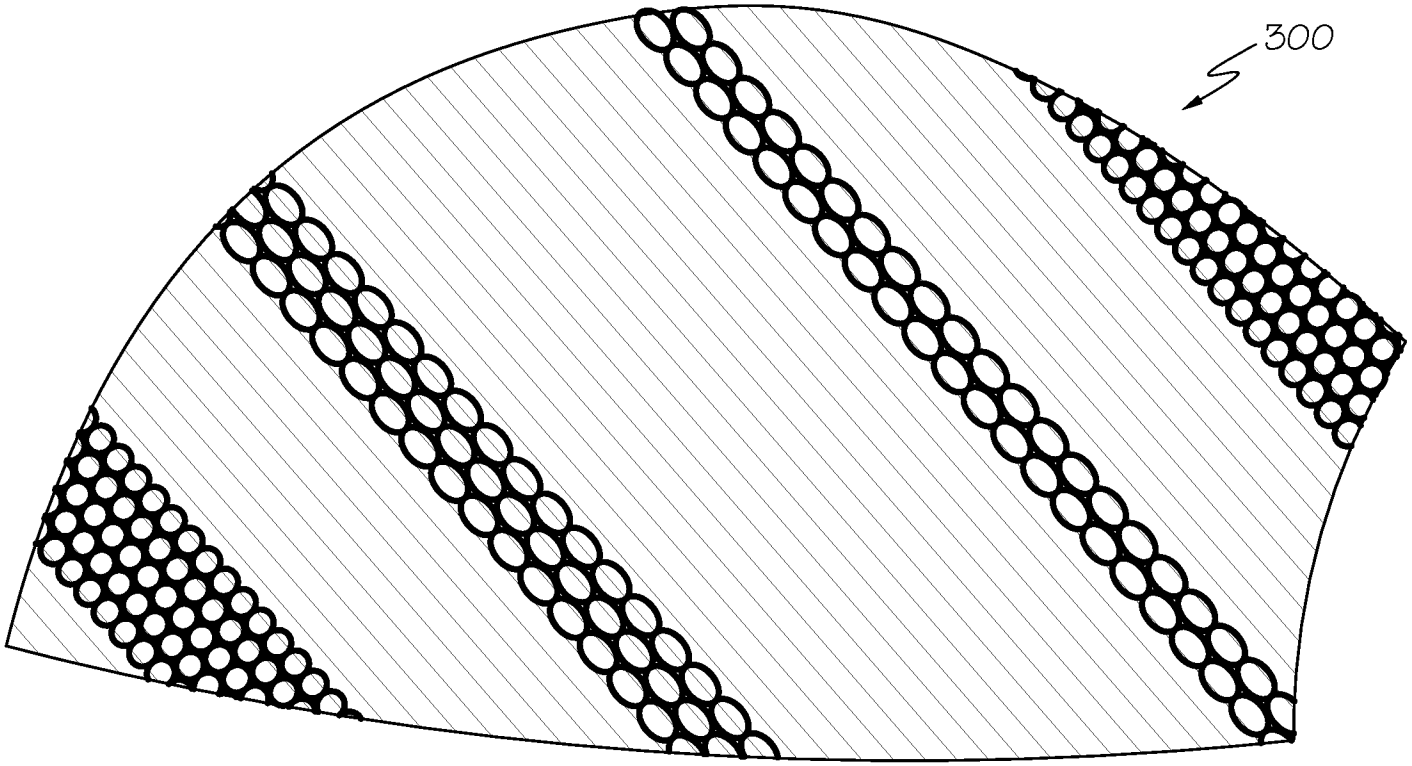
FIG. 3 illustrates a front view of a specifically shaped three dimensional weave fabric component to be assembled into a woven hat in accordance with the disclosed architecture.
Figure 4:
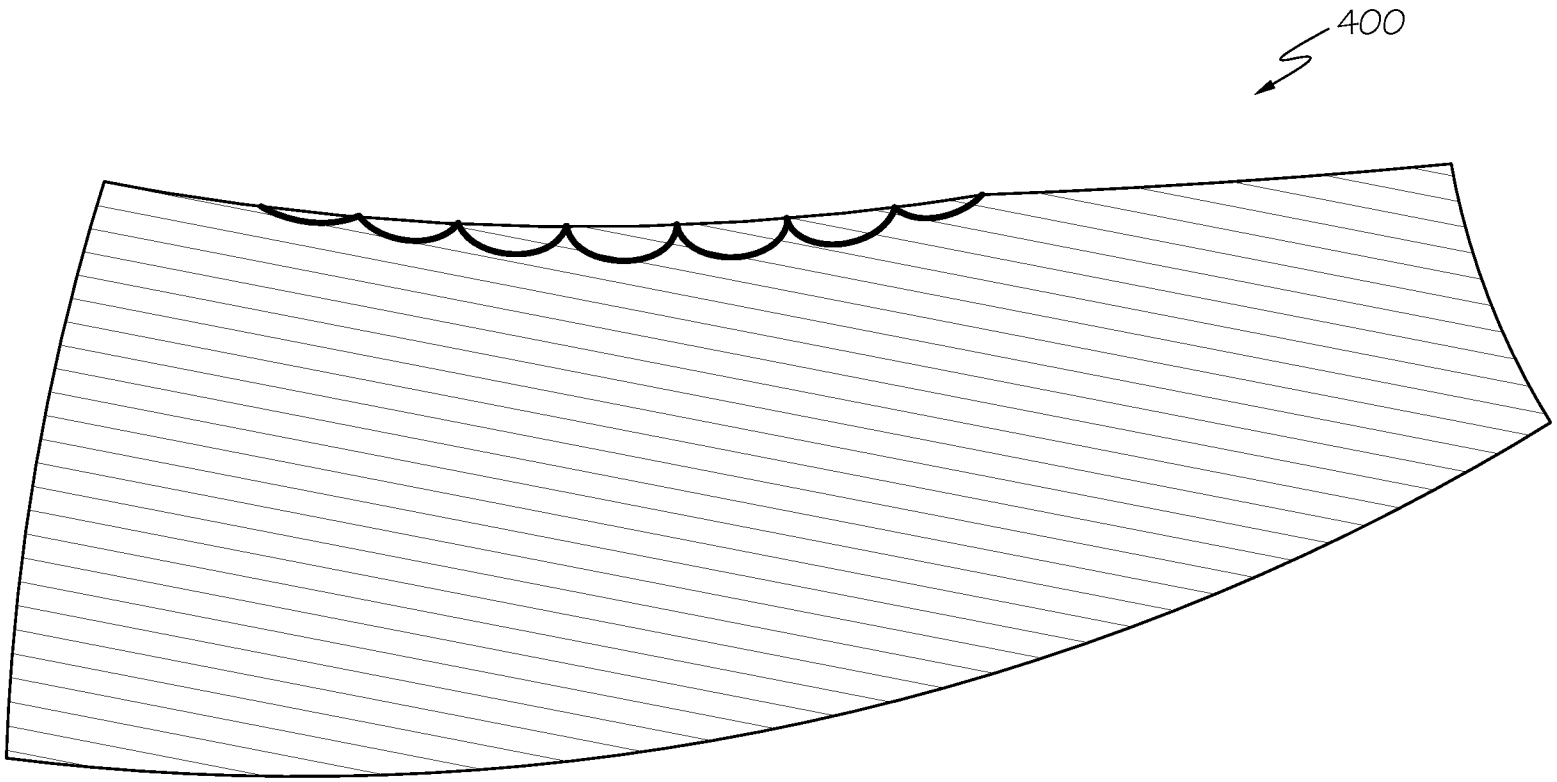
FIG. 4 illustrates a front view of a specifically shaped three dimensional weave fabric component to be assembled into a woven hat in accordance with the disclosed architecture.
Figure 5:
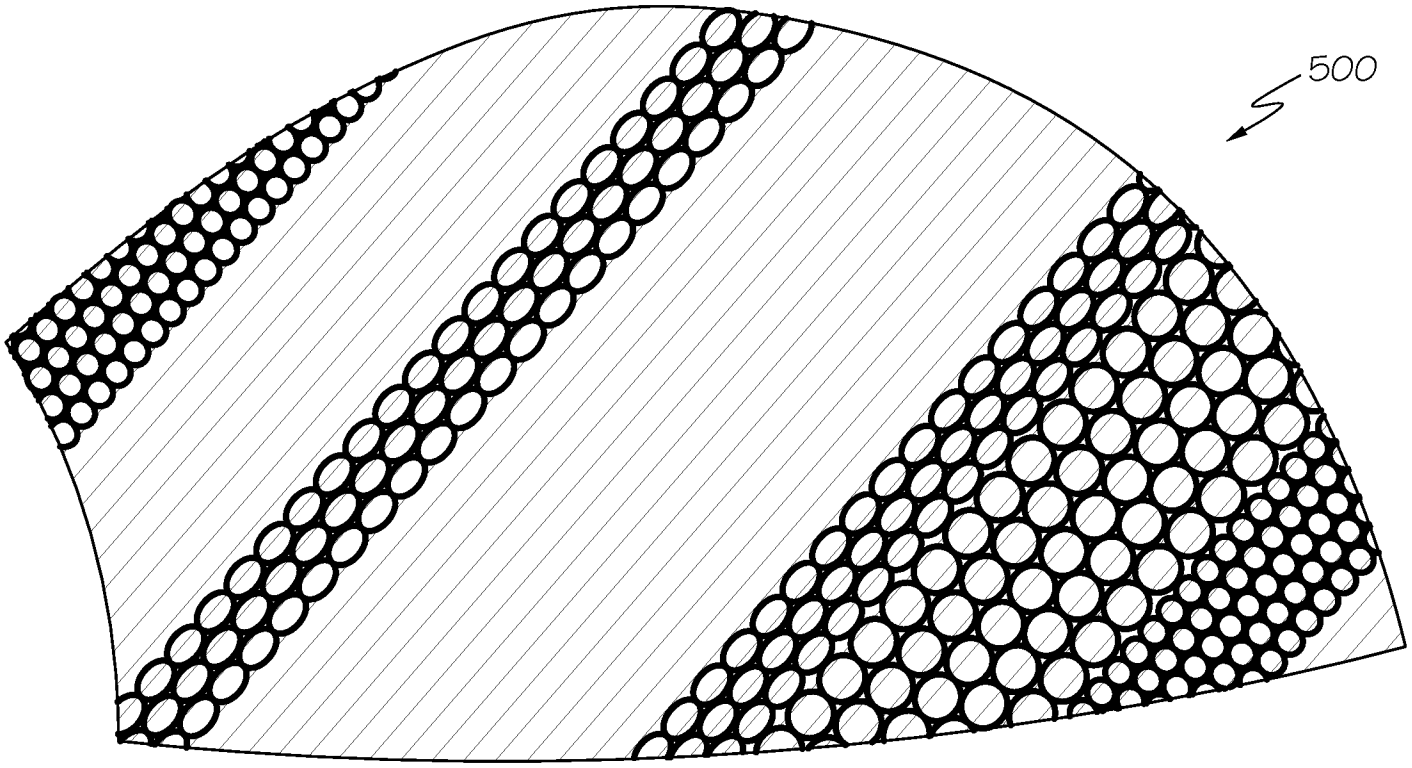
FIG. 5 illustrates a front view of a specifically shaped three dimensional weave fabric component to be assembled into a woven hat in accordance with the disclosed architecture.
Figure 6:
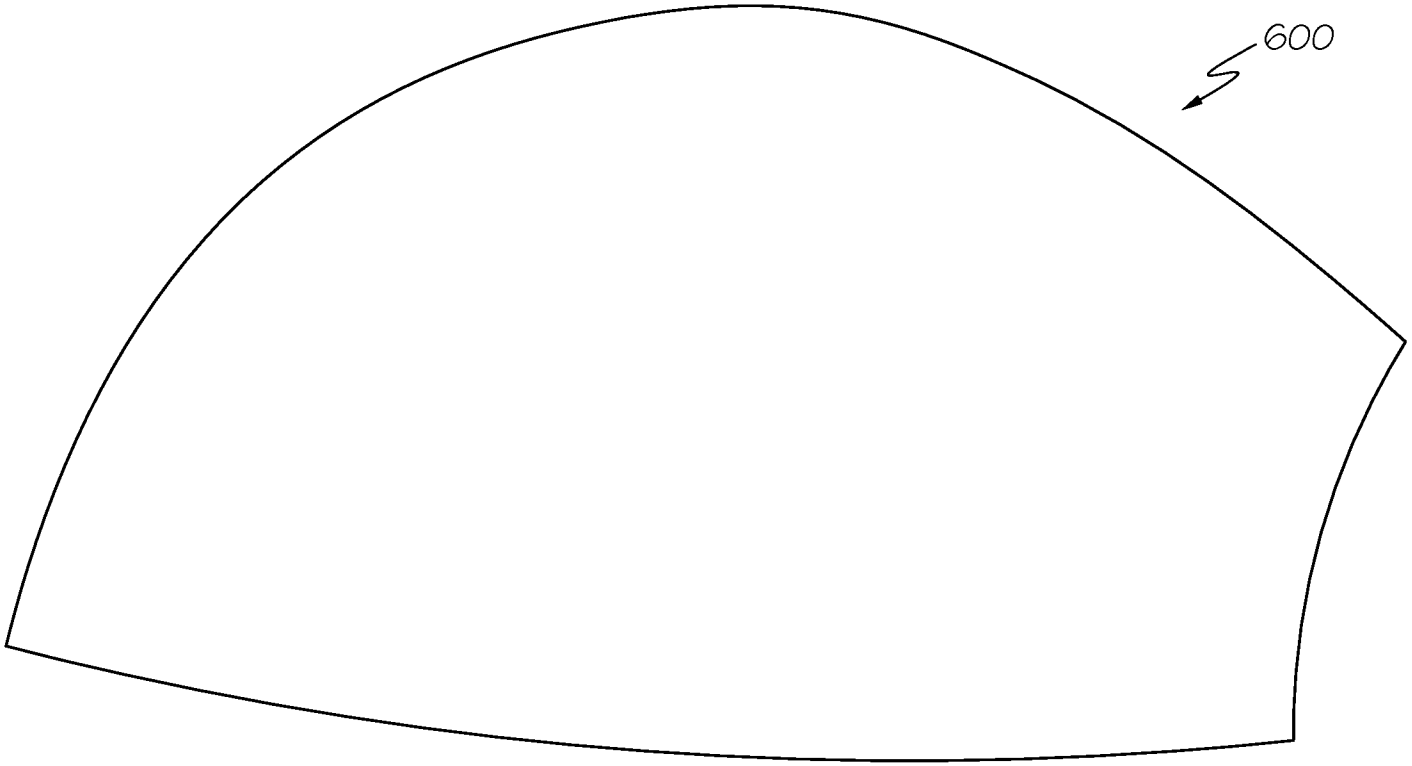
FIG. 6 illustrates a front view of a specifically shaped three dimensional weave fabric component to be assembled into a woven hat in accordance with the disclosed architecture.
Figure 7:
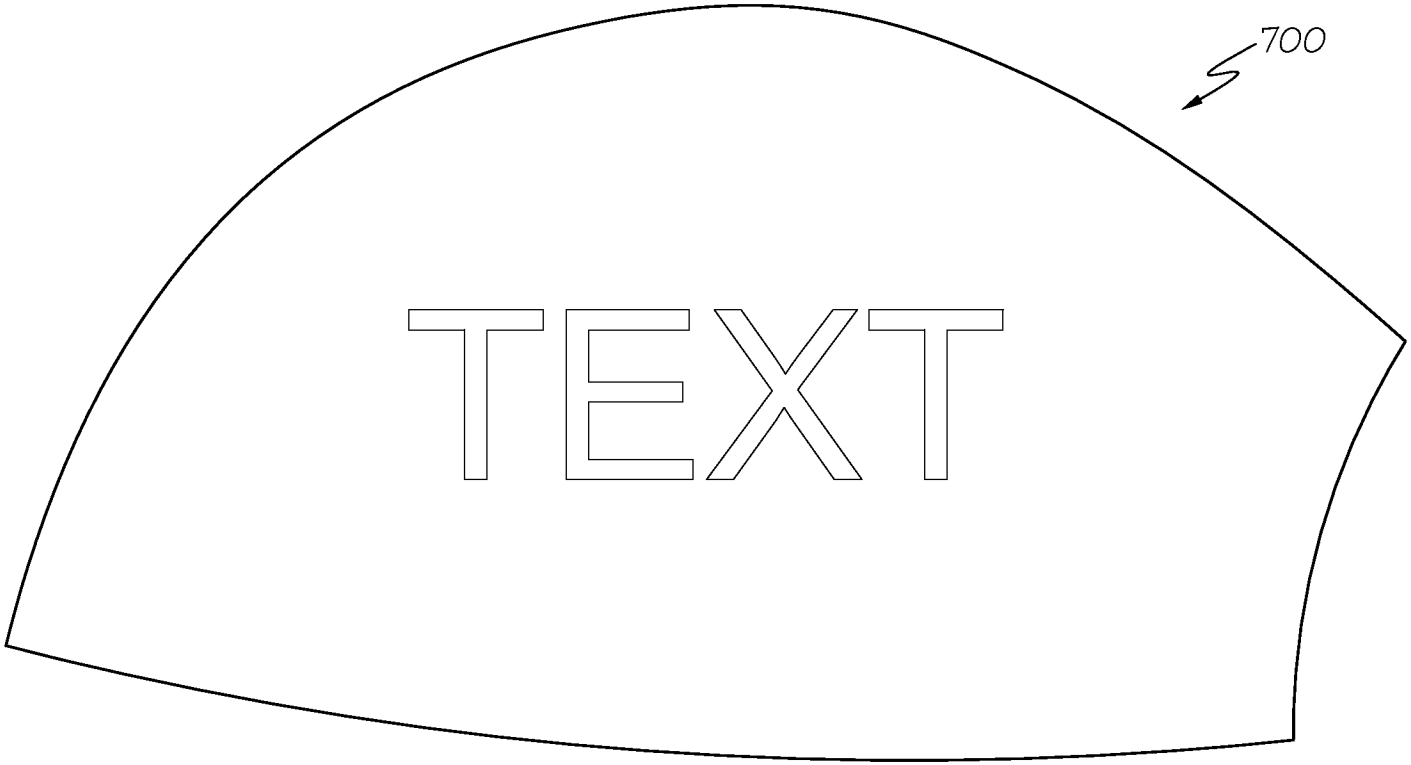
FIG. 7 illustrates a front view of a specifically shaped three dimensional weave fabric component to be assembled into a woven hat in accordance with the disclosed architecture.
Figure 8:
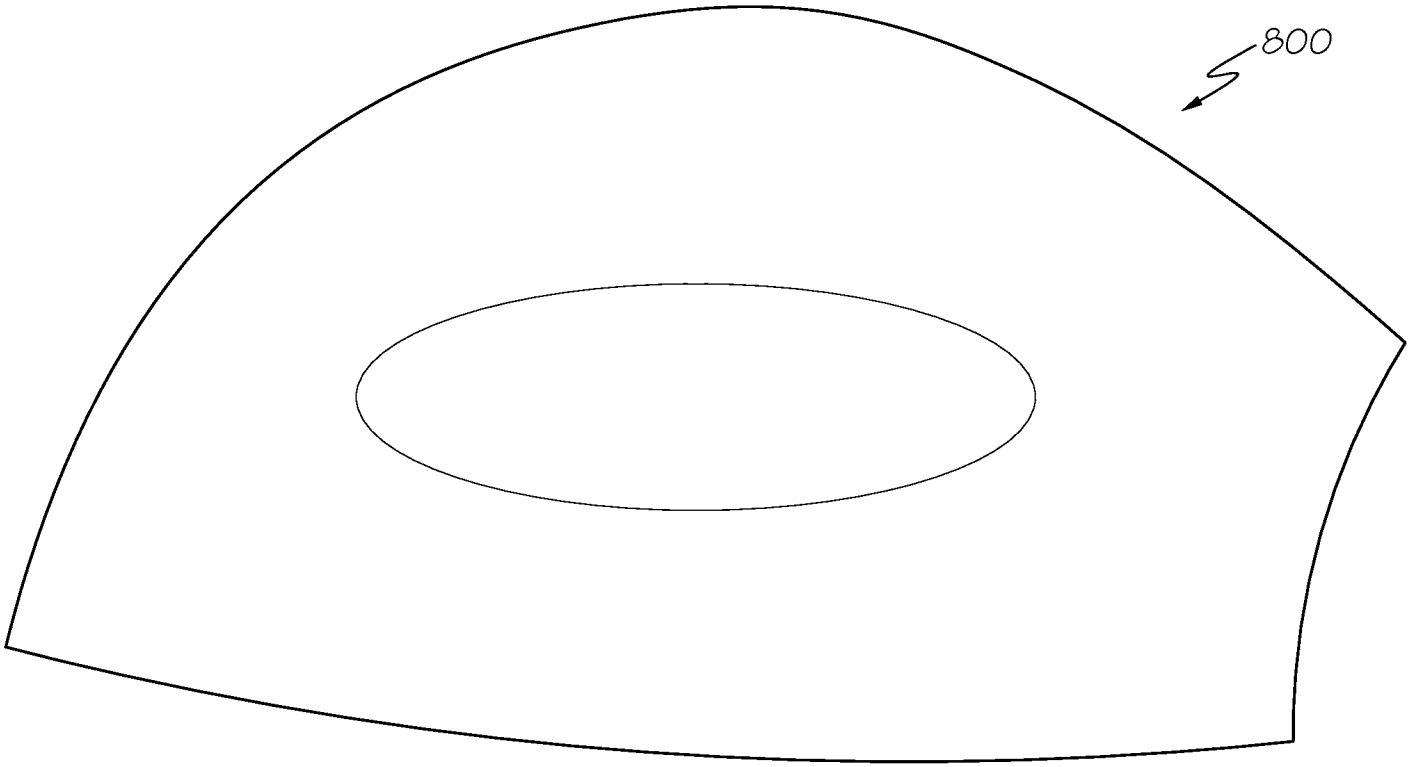
FIG. 8 illustrates a front view of a specifically shaped three dimensional weave fabric component to be assembled into a woven hat in accordance with the disclosed architecture.
Figure 9:
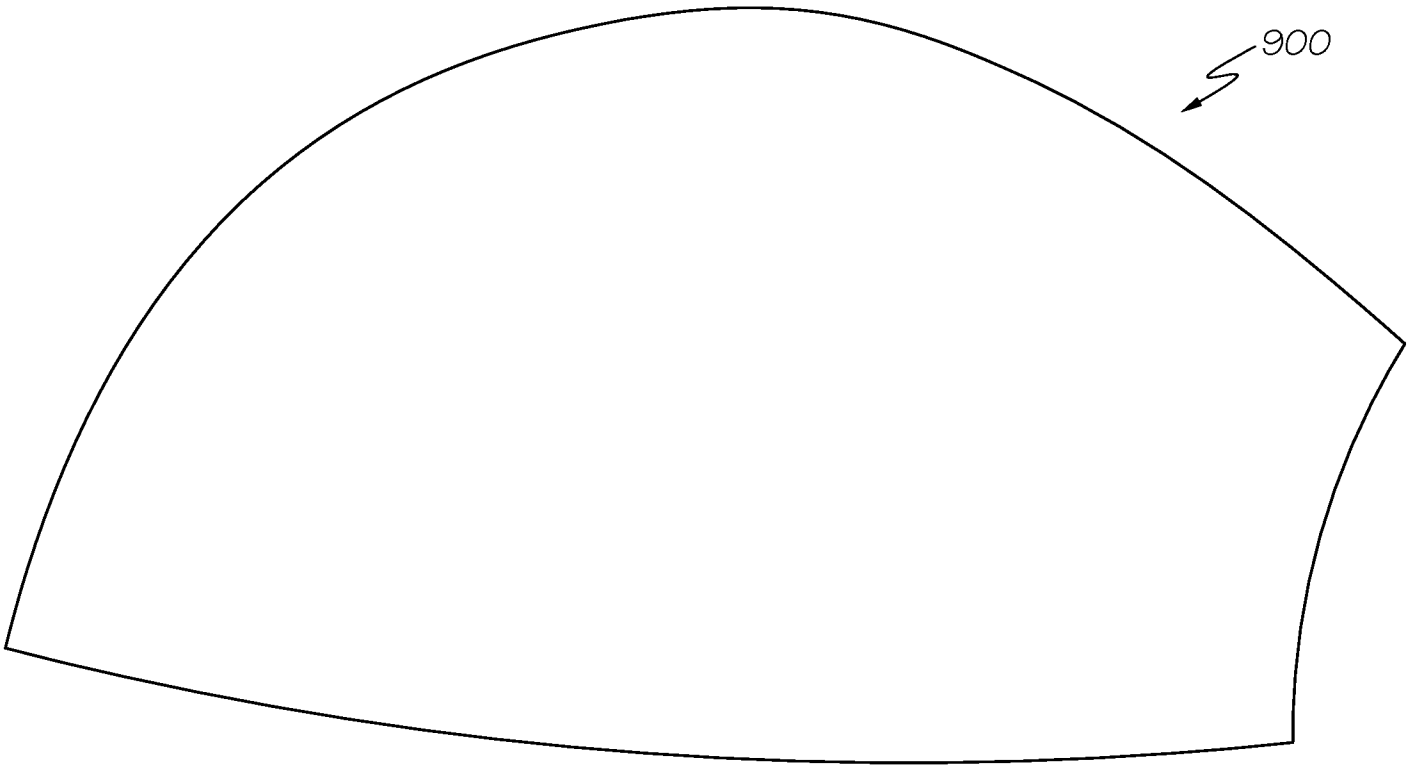
FIG. 9 illustrates a front view of a specifically shaped three dimensional weave fabric component to be assembled into a woven hat in accordance with the disclosed architecture.
Figure 10:
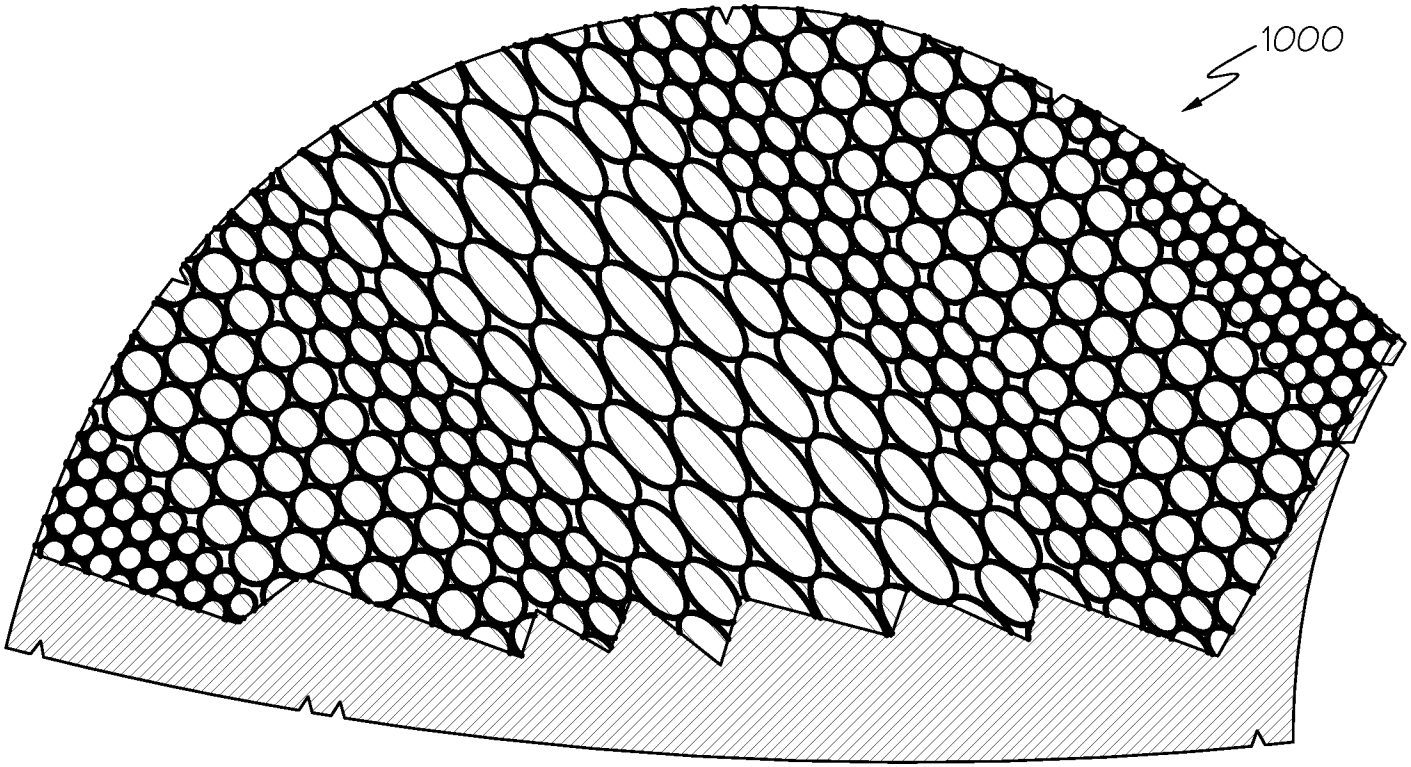
FIG. 10 illustrates a front view of a specifically shaped three dimensional weave fabric component to be assembled into a woven hat in accordance with the disclosed architecture.

Referring initially to the drawings, FIGS. 1A-B and 2 illustrates a three dimensional weave fabric material 100 for use in producing woven hats and other items. Using the three dimensional weave fabric for producing woven hats is merely one possible example and the same fabric material may be used for any suitable application. Thus, although the term "fabric" is used throughout the present disclosure for exemplary purposes, the term "fabric" may be any single item or material, or a group of items or material.

The three dimensional weave fabric material 100 comprises two layers of material, a face (or surface) layer 102 and a back layer 104 (as shown in FIG. 2). Typically, the face layer 102 and the back layer 104 are manufactured of synthetic material, or synthetic blends, such as polyester, but any other suitable material can be used as is known in the art without affecting the overall concept of the invention. The face layer 102 and the back layer 104 can be any suitable shape and size depending on the needs and wants of a user, as well as manufacturing constraints.

The face layer 102 and the back layer 104 are then woven together via threads 106. The threads 106 are preferably floating lycra threads but can be any other suitable material as is known in the art. For example, the threads 106 used may be monofilament yarns, multifilament yarns, spun yarns, etc. as desired, and these threads 106 can be made from artificial, natural or synthetic fibers depending on the user's needs or wants, and/or manufacturing constraints. The threads 106 may also be elastic or non-elastic yarn, or various combinations thereof. The type of threads 106 weaving the face layer 102 and the back layer 104 together throughout the body of the fabric material 100 and the number of yarns may be varied over wide ranges and will be primarily controlled by the desired end use for the fabric material 100. Typically, the threads 106 have a denier of from 30 to 300 and preferably between 70 and 300 denier.

The face layer 102 and the back layer 104 are woven together to create predetermined patterns or areas where the two layers 102 and 104 are not woven together. These areas which are not woven together create tubes (tunnels or gaps or pockets) 108. Specifically, the weaving is controlled by a computer program that will weave or not weave the two layers 102 and 104 together. Typically, the three dimensional fabric material 100 is produced on customized or purpose-built weaving machines, which incorporate a computer program to control the action of the threads 106.

Accordingly, the face layer 102 includes sequential unstitched surface portions and sequential stitched surface portions formed in an alternating and repeating pattern. For example, standard weaving will continue row after row. Then, when a tube or gap 108 is to be formed, the floating threads 106 are pushed into the two layers 102 and 104 (similar to a sewing machine), and then the weaving or sewing stops and resumes when enough space has been created for a gap or tube 108 to form. The ratio of spacking between woven and unwoven areas can range almost zero to 1 to 10 or even higher. Specifically, the warp (or longitudinal threads of the weave) are split in order to create this gap or tube 108. This process is then repeated row after row until all the weaving is done.

Once the weaving is complete (as shown in FIG. 1A), the three dimensional weave fabric material 100, in one exemplary embodiment is then heat treated. The three dimensional weave fabric material 100 can be heat treated via any suitable heat treating process as is known in the art. The heat treating process shrinks the floating threads 106, causing manipulation of the tube or gap 108. Specifically, the tube or gap 108 puffs or stands up more than if there was no heat treatment (as shown in FIG. 1B). Using synthetic material or synthetic blends for layers 102 and 104 allows the heat treating to shrink the synthetic material so as to create the puffed or raised areas which are readily distinguishable from the surround areas. The bigger surface area there is on the material, the more puffing can be created by the heat treatment, assuming of course the end user, in their respective fashion preference or design prefers the surface area to be covered with a large amount of raised areas. Typically, the puffed design extends into both layers of the three dimensional weave fabric material 100, creating the three dimensional design. However, the puffed design can be manipulated so that it is more exaggerated on one side or layer than the other side or layer. Additionally, the tubes or gaps 108 can be filled with fibers or other suitable materials as is known in the art to make the puffed areas more firm, or to add texture or other similar features.

Thus, the three dimensional weave fabric material 100 can be any suitable size, shape, and pattern as is known in the art without affecting the overall concept of the invention. One of ordinary skill in the art will appreciate that the size and/or shape of the face layer 102 and the back layer 104 as shown in FIGS. 1A and 1B is for illustrative purposes only and many other sizes and/or shapes of the layers 102 and 104 are well within the scope of the present disclosure. Although dimensions of the layers 102 and 104 (i.e., length, width, and height) are important design parameters for good performance, the layers 102 and 104 may be any size and/or shape that ensures an optimal stretch function and other performance characteristics.

FIGS. 3-10 illustrate the three dimensional weave fabric material shaped into different segments (or parts) of a hat. Specifically, FIGS. 3-10 disclose a plurality of heat-treated three dimensional weave fabric components 300, 400, 500, 600, 700, 800, 900, 1000 of specific shape and size depending on the wants and/or needs of a user and/or manufacturing constraints. These three dimensional weave fabric components are shaped to form different segments (or parts) of the woven hats. The woven hats (as shown in FIG. 11) are then produced by assembling the plurality of different woven components 300, 400, 500, 600, 700, 800, 900, 1000 together. Specifically, the different parts of the woven hat were separated, then four to six different woven components were created by heat treating the woven fabric material. Once the woven components were heat-treated, the components were assembled together into the finished hat (see FIG. 11). Alternately, no heating may be applied to the components which will still create textural differences in the product itself when compared to the surrounding areas of the product.

The woven components can be assembled into any suitable hat or cap as is known in the art, and the size and shape of tubes, tunnels or gaps in the components are adjusted accordingly depending on the size and shape of the hat to be produced and the particular design that is being created. One of ordinary skill in the art will appreciate that the size and/or shape of the heat-treated woven components 300, 400, 500, 600, 700, 800, 900, 1000 as shown in FIGS. 3-10 is for illustrative purposes only and many other sizes and/or shapes of the woven components are well within the scope of the present disclosure. Although dimensions of the woven components (i.e., length, width, and height) are important design parameters for good performance, the tunnels, gaps, tubes of the woven components may be any size and/or shape that ensures an optimal function, such as stretch and other performance characteristics.

FIGS. 11A-D illustrate a plurality of woven hats produced by the three dimensional weave fabric 100 components, with at least one of the components having one or more unwoven areas forming tubes, tunnels or gaps in the weaving. Specifically, a plurality of woven components (300, 400, 500, 600, 700, 800, 900, 1000) are produced (as shown in FIGS. 3-10), the plurality of woven components (300, 400, 500, 600, 700, 800, 900, 1000) are then assembled into a woven hat (1100, 1102, 1104, 1106) which is then 100% woven except for perhaps the bill or rim (or brim) of the woven hat which would comprises additional stiffener components, such as cardboard, paperboard, etc. in order to provide the necessary strength for the bill or brim of the hat.

Figure 11B:
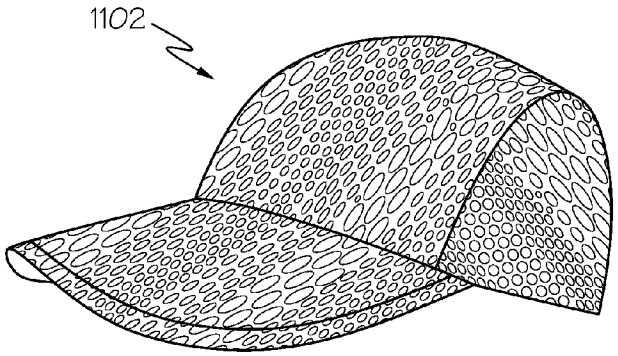
FIGS. 11A-D illustrate a perspective view of the three dimensional weave fabric material in use as a plurality of woven hats in accordance with the disclosed architecture.
Figure 11A:
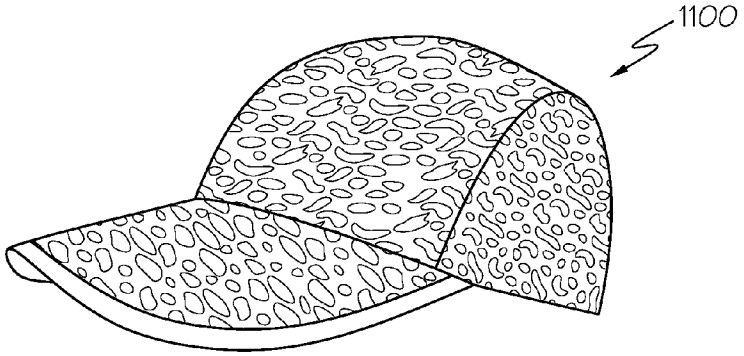
Figure 11D:
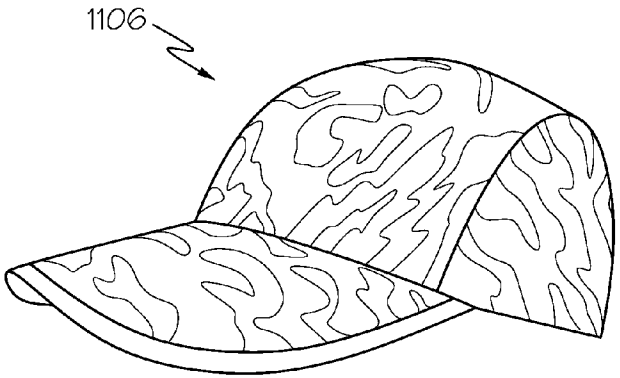
Figure 11C:
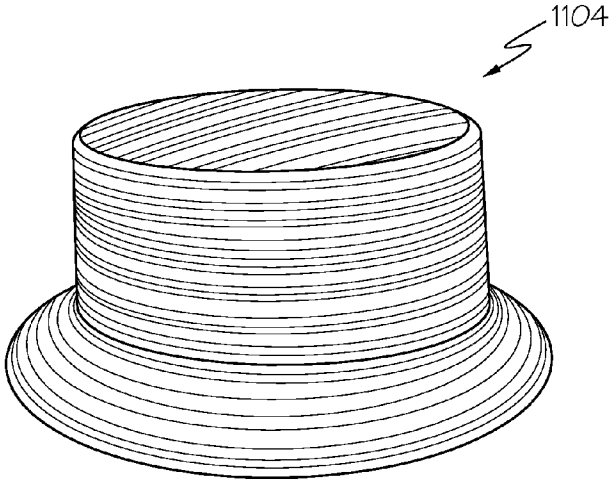

The heat treated three dimensional weave fabric components can be created or produced into different textures or designs by varying the heat treatment, thread colors, weave design. Specifically, there are four unique designs or textures shown in FIGS. 11A-D (i.e., stone, snake, leopard, and geometry) created for the woven hat and in this particular example formation of a "baseball style" type of hat or cap. All of the unique designs show vivid colors and details and are differentiated from the normal fabric feel by the pronounced puffs and ridges caused by forming tunnels, tubes or gaps in the weaving of the fabric and then subjecting the woven components to possible post weaving treatments such as heat treatment. Specifically, FIG. 11A discloses a woven hat 1100 with a leopard pattern and an elongated bill. FIG. 11B discloses a woven hat 1102 with a snake pattern and an elongated bill. FIG. 11C discloses a woven hat 1104 with a stone color/pattern and a round brim or rim. FIG. 11D discloses a woven hat 1106 with a geometry pattern and an elongated bill.

Furthermore, the patterns and/or designs can be woven over the entire area of the hat, or just in limited areas on the hat, depending on the needs and wants of a user as well as manufacturing constraints. Any pattern and/or design can be woven and the pattern and/or design can be of any shape or size. There can be a plurality of the same pattern and/or design, or a mixture of patterns and/or designs. Large patterns and/or designs can be utilized or small patterns and/or designs, or combinations of both large and small patterns and/or designs can be utilized. The different size and/or shape of the patterns and/or designs are created by varying the size of the tube or gap that is woven. Any size and/or shaped hat or other item can be created with the pattern and/or design. Further, the patterns and/or designs can be used in woven labels, such as those labels found on the interior of a garment or hat to help with branding.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A three dimensional weave fabric material hat, comprising:

a plurality of three dimensional weave fabric components woven into a plurality of predetermined shapes, wherein each of the plurality of three dimensional weave fabric components comprise:

a face layer; and a back layer;

wherein the face layer is woven to the back layer via a plurality of floating threads to create a predetermined pattern; and wherein the predetermined pattern comprises puffed tubes that are areas where the face layer and the back layer are not woven together; and wherein the plurality of three dimensional weave fabric components are assembled to form a woven hat.

2. The three dimensional weave fabric material hat of claim 1, wherein the weaving is controlled by a computer program that will weave or not weave the face layer and the back layer together.

3. The three dimensional weave fabric material hat of claim 2, wherein the tubes are subject to a heat shrinking process that shrinks the floating threads.

4. The three dimensional weave fabric material hat of claim 1, wherein the puffed tubes can be manipulated such that the puffing is more exaggerated on the face layer.

5. The three dimensional weave fabric material hat of claim 1, wherein the puffed tubes can be manipulated such that the puffing is more exaggerated on the back layer.

6. The three dimensional weave fabric material hat of claim 1, wherein the predetermined pattern is woven over an entire area of the woven hat.

7. The three dimensional weave fabric material hat of claim 1, wherein the predetermined pattern is woven over a limited area of the woven hat.

8. The three dimensional weave fabric material hat of claim 1, wherein the tubes are filled with fibers to add texture.

9. A three dimensional weave fabric material for producing woven hats, comprising:

a face layer; and a back layer;

wherein the face layer is woven to the back layer via a plurality of floating threads to create a predetermined pattern; and wherein the predetermined pattern comprises tubes that are areas where the face layer and the back layer are not woven together; and wherein the tubes are manipulated, causing the tubes to puff.

10. The three dimensional weave fabric material for producing woven hats of claim 9, wherein the three dimensional weave fabric material is woven into a plurality of predetermined shapes.

11. The three dimensional weave fabric material for producing woven hats of claim 10, wherein the plurality of predetermined shaped material is assembled to form a woven hat.

12. The three dimensional weave fabric material for producing woven hats of claim 11, wherein the weaving is controlled by a computer program that will weave or not weave the face layer and the back layer together.

13. The three dimensional weave fabric material for producing woven hats of claim 12, wherein the tubes are filled with fibers to add texture.

14. The three dimensional weave fabric material for producing woven hats of claim 9, wherein the predetermined pattern is woven over an entire area of the woven hat.

15. The three dimensional weave fabric material for producing woven hats of claim 9, wherein the predetermined pattern is woven over a limited area of the woven hat.

16. The three dimensional weave fabric material for producing woven hats of claim 9, further comprising a mixture of more than one predetermined pattern on an entire area of the woven hat.

17. A three dimensional weave fabric material for garments, comprising:

a face layer; and a back layer;

wherein the face layer is woven to the back layer via a plurality of floating threads to create a predetermined pattern; and wherein the predetermined pattern comprises tubes that are areas where the face layer and the back layer are not woven together; and wherein the tubes are manipulated via a heat shrinking process to shrink the floating threads, causing the tubes to puff;

wherein the tubes are filled with fibers to add texture; and wherein the weaving is controlled by a computer program that will weave or not weave the face layer and the back layer together.

18. The three dimensional weave fabric of claim 17, wherein the garment is a woven hat.

19. The three dimensional weave fabric of claim 17, wherein the three dimensional weave fabric can be utilized in a woven label on an interior of a garment.

20. The three dimensional weave fabric of claim 18, wherein different sizes and shapes of patterns are created by varying size of the tubes that are woven.

* * * * *